US008141176B2

(12) United States Patent
Lee

(10) Patent No.: US 8,141,176 B2
(45) **Date of Patent: *Mar. 27, 2012**

(54) PANTS HAVING BODY-SHAPING FUNCTION

(75) Inventor: Sung Woo Lee, Gwacheon (KR)

(73) Assignee: Eun Hyo Cho (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/093,402

(22) Filed: Apr. 25, 2011

(65) Prior Publication Data

US 2011/0197342 A1 Aug. 18, 2011

Related U.S. Application Data

(62) Division of application No. 11/599,973, filed on Nov. 15, 2006, now Pat. No. 7,950,069.

(30) Foreign Application Priority Data

| | | |
|---|---|---|
| Nov. 16, 2005 | (KR) | 20-2005-0032369 U |
| Mar. 8, 2006 | (KR) | 20-2006-0006177 U |
| Jun. 21, 2006 | (KR) | 20-2006-0016686 U |
| Jul. 11, 2006 | (KR) | 20-2006-0018674 U |
| Aug. 10, 2006 | (KR) | 10-2006-0075694 |

(51) Int. Cl.
*A41D 1/06* (2006.01)
*A41D 13/02* (2006.01)

(52) U.S. Cl. ..... 2/227

(58) Field of Classification Search ..... 2/79, 77, 2/215, 217, 227, 409; 450/94, 95, 100, 101, 450/104, 107, 114, 115, 116, 117, 118, 122, 450/123, 124, 128, 150, 151

See application file for complete search history.

(56) References Cited

U.S. PATENT DOCUMENTS 2,332,141 A * 10/1943 Greene ..... 450/98

(Continued)

FOREIGN PATENT DOCUMENTS

EP 1559334 A1 * 8/2005

(Continued)

OTHER PUBLICATIONS

Japanese Office Action, 4 pages.*

(Continued)

*Primary Examiner* — Gary L Welch
*Assistant Examiner* — Amber Anderson
(74) *Attorney, Agent, or Firm* — Greenlee Sullivan P.C.

(57) ABSTRACT

Provided is pants having a body-shaping function including; an elastic fabric included in the pants, and having a boundary that is partially fixed on the pants to elastically support hips of a wearer; and a hip-up band fixed on the elastic fabric to push the hips up so as to make contours of the hips more voluminous or compression bands on lower side portions of the elastic fabric in order to compress thighs of the wearer so as to make the thighs look thin, or a pair of pads having predetermined thicknesses and disposed on the elastic fabric to make the hips of the wearer look more attractive. Therefore, since the elastic fabric is integrally fixed in the pants for shaping the hips, the conventional girdle is not required. In addition, since the girdle in the pants only compresses the hips, it does not affect blood circulation around the belly, and is easily wearable. Also, the contours of the hips look more attractive due to the pads.

1 Claim, 12 Drawing Sheets

U.S. PATENT DOCUMENTS

| | | | | | |
|---|---|---|---|---|---|
| 2,487,893 | A | * | 11/1949 | Rockwell | 450/104 |
| 2,752,599 | A | * | 7/1956 | Laguzzi | 450/104 |
| 2,971,515 | A | * | 2/1961 | Geissmann | 450/118 |
| 3,127,896 | A | * | 4/1964 | Puliafico | 450/95 |
| 3,214,770 | A | * | 11/1965 | Smith | 2/227 |
| 3,215,770 | A | * | 11/1965 | Lynch | 348/507 |
| 3,295,530 | A | * | 1/1967 | Mayer et al. | 450/98 |
| 3,406,692 | A | * | 10/1968 | Pernas | 450/116 |
| 5,749,101 | A | * | 5/1998 | Breindel | 2/403 |
| 5,842,232 | A | * | 12/1998 | Parrish | 2/400 |
| 5,888,118 | A | * | 3/1999 | Kishi | 450/122 |
| 5,954,564 | A | * | 9/1999 | Ganz | 450/99 |
| 6,182,297 | B1 | * | 2/2001 | Duren et al. | 2/228 |
| 6,205,591 | B1 | * | 3/2001 | Wheeler et al. | 2/227 |
| 6,874,337 | B2 | * | 4/2005 | Uno et al. | 66/177 |
| 7,087,032 | B1 | * | 8/2006 | Ikeda | 602/19 |
| 7,341,500 | B2 | * | 3/2008 | Horn et al. | 450/95 |
| 7,377,834 | B2 | * | 5/2008 | Fu | 450/99 |
| 7,559,093 | B2 | * | 7/2009 | Sudo et al. | 2/69 |

FOREIGN PATENT DOCUMENTS

| | | | | |
|---|---|---|---|---|
| JP | 4-12412 | | * | 7/1992 |
| JP | 6-12412 | | * | 2/1994 |
| JP | 08-060408 | | * | 3/1996 |
| JP | 08-158109 | | * | 6/1996 |
| JP | 09-059808 | | * | 3/1997 |
| JP | 2003-301311 | | * | 10/2003 |
| JP | 3605806 | B1 | * | 12/2004 |
| JP | 2005-171477 | | * | 6/2005 |
| KR | 20-0215437 | | * | 3/2001 |
| KR | 20-0418482 | | * | 6/2003 |
| WO | WO2004029987 | A1 | * | 4/2005 |
| WO | WO2005029987 | A1 | * | 4/2005 |

OTHER PUBLICATIONS

European Search Report, European Application No. 06023698.1, Aug. 27, 2007, 11 pages.*

Office Action from Korean Intellectual Patent Office, Korean Patent Application 10-2006-0075694, Apr. 19, 2007, 3 Pages.*

* cited by examiner

PANTS HAVING BODY-SHAPING FUNCTION

CROSS-REFERENCE TO RELATED PATENT APPLICATIONS

This application is a divisional of U.S. patent application Ser. No. 11/559,973, filed Nov. 15, 2006, which claims the benefit of Korean Utility Application Nos. 20-2005-0032369, filed on Nov. 16, 2005, 20-2006-0006177, filed on Mar. 8, 2006, 20-2006-0016686, filed on Jun. 21, 2006 and 20-2006-0018674, filed on Jul. 11, 2006 and Korean Patent Application No. 10-2006-0075694, filed on Aug. 10, 2006, in the Korean Intellectual Property Office, the disclosure of which are incorporated herein in their entirety by reference.

BACKGROUND OF THE INVENTION

1. Field of the Invention

The present invention relates to pants capable of shaping the body of a person wearing them.

2. Description of the Related Art

Generally, women pay more attention when they buy clothes, and thus, various kinds of clothes have been developed to make women feel comfortable and to satisfy their own style and taste. Clothes for women perform not only basic functions of clothing, but also satisfy women's desires for becoming more beautiful and attractive.

Meanwhile, underwear that is mainly used to shape the body of a wearer changes the contour of the body, and fundamentally makes the appearance of the outwear look better. For example, a girdle pushes the hips of the wearer or tightens the thighs up by distributing subcutaneous fat of the wearer, and thus, makes the hips look slimmer when the wearer wears tight jeans, thereby improving the appearance and self-esteem of the wearer.

However, since the conventional girdle hardly expands in order to compress the body, it is difficult to wear and take off the girdle, and the girdle may affect the blood circulation because the girdle tightens the hips or thighs of the wearer. In addition, the girdle may push the hips to some degree or tighten the thighs up to make them look thin, however, it cannot provide a shaping effect, that is, it makes skinny hips look bigger.

SUMMARY OF THE INVENTION

The present invention provides pants having a body shaping function, the pants including an elastic fabric fixed integrally therein for shaping the hips, and thus being capable of shaping the hips only by wearing the pants without the use of conventional girdles, the pants pressing only the hips unlike conventional girdle so as not to affect blood circulation around belly, being easily wearable, and making the hips look more attractive if a pad is used.

According to an aspect of the present invention, there is provided pants having a body-shaping function, the pants including: an elastic fabric included in the pants, and having a boundary that is partially fixed on the pants to elastically support the hips of a wearer; and a hip-up band fixed on the elastic fabric to push the hips up so as to make the contours of the hips voluminous.

The pants may further include: supporting bands that are fixed on both end portions of the hip-up band on both sides of the elastic fabric and extend upward so as to push the hips inward.

The pants may further include: tensile bands that are fixed on both end portions of the hip-up band with the supporting bands and extend in a length direction to pull the elastic fabric in a status where extending end is fixed on the pants so that the elastic fabric can be adhered onto the hips.

The pants may further include: compression bands on lower side portions of the elastic fabric in order to compress thighs of the wearer so as to make the thighs look thin.

The tensile bands may be fixed on both end portions of the hip-up band and extend in a length direction of the pants to pull the elastic fabric in a status where extending end is fixed on the pants so that the elastic fabric can be adhered onto the hips.

The compression bands may be formed on lower side portions of the elastic fabric in order to compress thighs of the wearer so as to make the thighs look thin.

The pants may further include: compression bands on lower side portions of the elastic fabric in order to compress thighs of the wearer so as to make the thighs look thin.

The pants may further include: supporting bands that are fixed on both end portions of the hip-up band on both sides of the elastic fabric and extend upward so as to push the hips that are pulled up by the hip-up band inward.

According to another aspect of the present invention, there is provided pants having a body-shaping function, the pants including: an elastic fabric included in the pants, and having a boundary that is partially fixed on the pants to elastically support hips of a wearer; and compression bands on lower side portions of the elastic fabric in order to compress thighs of the wearer so as to make the thighs look thin.

According to another aspect of the present invention, there is provided pants having a body-shaping function, the pants including: an elastic fabric included in the pants, and having a boundary that is partially fixed on the pants to elastically support hips of a wearer; and a pair of pads having predetermined thicknesses and disposed on the elastic fabric to make the hips of the wearer look voluminous.

The elastic pad may include pocket portions receiving the pads so as to locate the pads on the elastic fabric.

Each of the pocket portions may have an opening so as to separate the pad from the pocket portion through the opening.

The elastic fabric may have both end portions that are fixed on sewing portions on both sides of the pants, an upper end portion fixed on a belt portion of the pants, and a lower center portion fixed on a crotch portion of the pants.

The elastic fabric may further include a hip-shaping band that pushes the hips up and tightens the hips to the center portion.

The elastic fabric may include a compression band that compresses the thighs of the wearer to make the thighs look thin.

The elastic fabric may include a compression band that compresses the thighs of the wearer to make the thighs look thin.

The pants may further include: second compression bands fixed on the sewing portions of the pants when being fixed on the hip-shaping band so as to tighten the hips of the wearer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
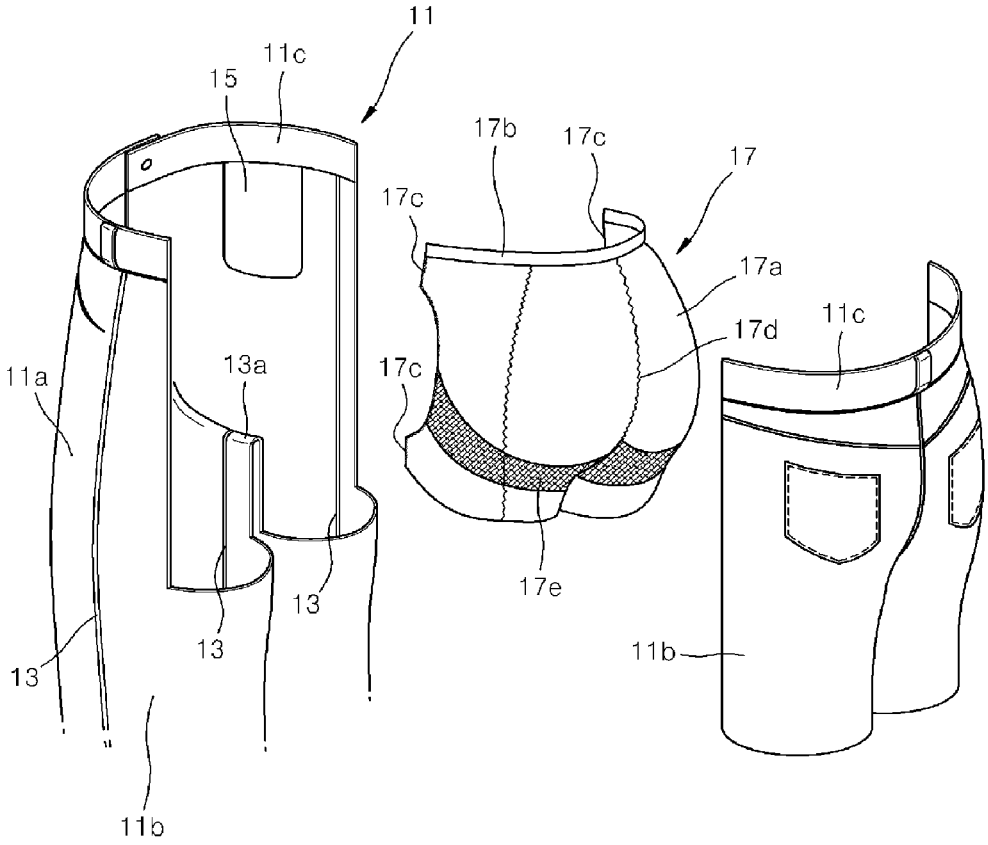
FIG. 1 is an exploded perspective view of an inner structure of pants having a body shaping function according to an embodiment of the present invention.

FIG. 1 is an exploded perspective view of an inner structure of pants having a body shaping function according to an embodiment of the present invention.

Referring to FIG. 1, pants 11 having a body shaping function according to the current embodiment include an elastic fabric 17*a* fixed integrally in the pants 11 and elastically attaching onto the hips of a wearer, and a hip-up band 17*e* fixed at a predetermined position on an outer side portion of the elastic fabric 17*a* to push the hips up. The elastic fabric 17*a* and the hip-up band 17*e* attached onto the elastic fabric 17*a* shape the hips of the wearer and are referred to as a girdle 17.

The pants 11 have a conventional shape and include a front portion 11*a* and a rear portion 11*b* that are coupled to each other through sewing, and a belt portion 11*c*. Reference numeral 13 is a sewing portion made by sewing the front portion 11*a* and the rear portion 11*b* to each other. The belt portion 11*c* surrounds the waist of the wearer, and is coupled to an upper end portion of the front portion and rear portion 11*a* and 11*b*. Reference numeral 15 is a pocket.

The girdle 17 covers the hips from behind unlike conventional girdles that surround the hips. Therefore, for example, if the girdle 17 is separated from the pants 11, the girdle 17 is not wearable anymore.

The elastic fabric 17*a* forming the girdle 17 may be a two-way fabric or other fabrics having a recovery force. A size of the elastic fabric 17*a* varies from the size of the pants 11.

An upper inseam 17*b*, that is, an upper end portion of the elastic fabric 17*a*, is sewed between the belt portion 11*c* of the pants and the rear portion 11*b*. In addition, side inseams 17*c* on both ends of the elastic fabric 17*a* are coupled to the sewing portion 13 of the pants 11. Although it is not shown in the drawings, a lower center portion of the elastic fabric 17*a* is sewed with a crotch 13*a* of the pants 11.

Therefore, the hips of the wearer are tightened between the front portion 11*a* and the elastic fabric 17*a*. If the pants 11 are tight, the girdle 17 is adhered to the rear portion 11*b*, and thus, the contours of the hips are revealed through the girdle 17 and the rear portion 11*b*.

In addition, a rubber thread sewing portion 17*d* is located on a center portion of the elastic fabric 17*a*. The rubber thread sewing portion 17*d* is formed by sewing the center portion of the elastic fabric 17*a* using a well-known rubber thread (sewing thread made of rubber). Since the rubber thread has elasticity, the elastic fabric 17*a* can be comfortably attached to the hips due to the elasticity of the rubber thread.

In particular, the rubber thread sewing portion 17*d* makes the wearer feel comfortable even during large movements and even each of wearers has slightly different sizes from each other.

Figure 2:
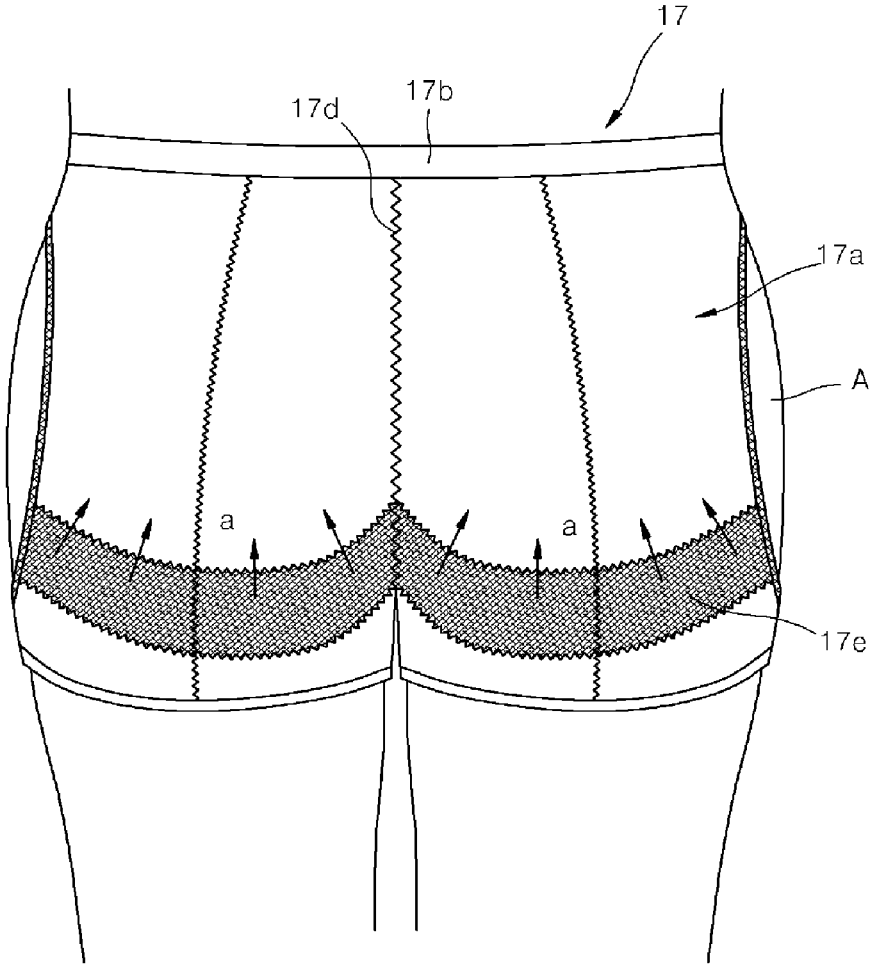
FIG. 2 is a diagram illustrating operations of a girdle of FIG. 1.

Meanwhile, the hip-up band 17*e* pushes the hips up in arrow direction a in FIG. 2 so as to tighten the hips, and is made of non-elastic fabric. For example, the hip-up band 17*e* can be formed of tricot fabric. Otherwise, the hip-up band 17*e* can be formed of mesh-type fabric.

As shown in FIG. 2, the hip-up band 17*e* is symmetric with respect to the center portion of the elastic fabric 17*a* to push the hips up in the arrow direction a. Therefore, sagging hips can be pulled up by the hip-up band 17*e* in the pants 11, thereby making the contours of the hips look attractive and beautiful by wearing the pants according to the current embodiment.

FIG. 2 is a diagram illustrating operations of the girdle 17 of FIG. 1.

As shown in FIG. 2, the elastic fabric 17*a* forming the girdle 17 is adhered to the hips (A) of the wearer, and in this status, the hip-up band 17*e* supports lower portions of the hips A upward in the arrow direction a. The shape of the hip-up band 17*e*, such as a curvature or a width of the band 17*e*, can be modified.

Figure 3:
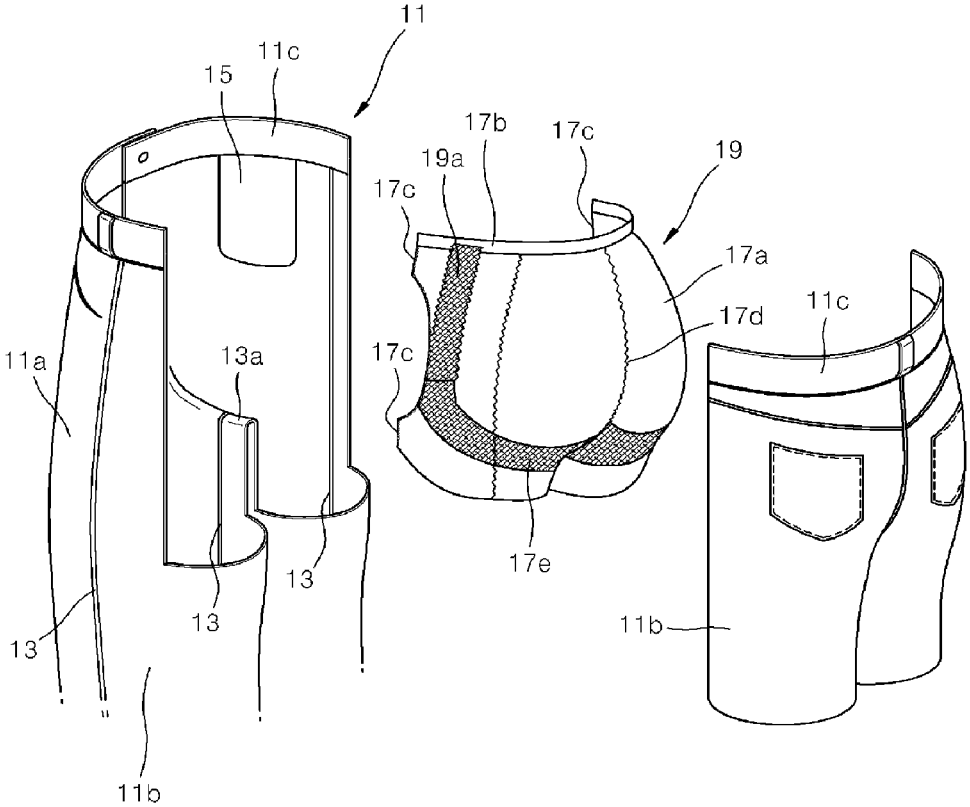
FIG. 3 is an exploded perspective view of an inner structure of pants having a body shaping function according to another embodiment of the present invention.
Figure 4:
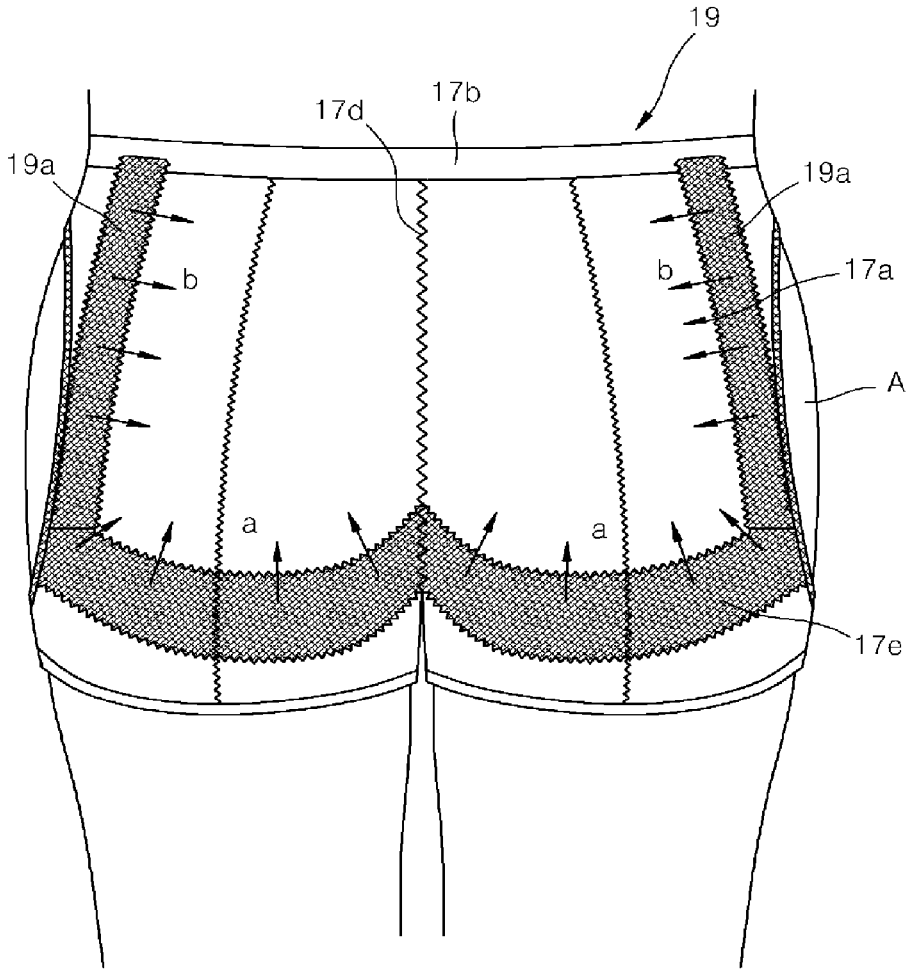
FIG. 4 is a diagram illustrating operations of a girdle of FIG. 3.

FIG. 3 is an exploded perspective view of an inner structure of pants 11 having a body shaping function according to another embodiment of the present invention, and FIG. 4 is a diagram illustrating operations of a girdle of FIG. 3.

Hereinafter, like reference numerals as in the previous embodiment denote identical elements, and detailed descriptions thereof will be omitted.

Referring to FIGS. 3 and 4, a girdle 19 included in the pants 11 according to the current embodiment has a pair of supporting bands 19*a*, besides the hip-up band 17*e*. The supporting bands 19*a* are non-elastic fabric members having lower ends connected to both ends of the hip-up band 17*e*, and extend toward the upper inseam portion 17*b*. Adjacent end portions of the hip-up band 17*e* and the supporting bands 19*a* are coupled to each other through sewing. The hip-up band 17*e* and the supporting bands 19*a* can be formed of the same non-elastic fabric, for example, mesh-type fabric, in consideration of air ventilation.

The supporting bands 19*a* are symmetrically fixed on both sides of the elastic fabric 17*a* as shown in FIG. 4 so as to push the hips A of the wearer in arrow direction b. Therefore, the hips A are not expanded by the supporting bands 19*a*, and thus, the hips A do not look too large.

Figure 5:
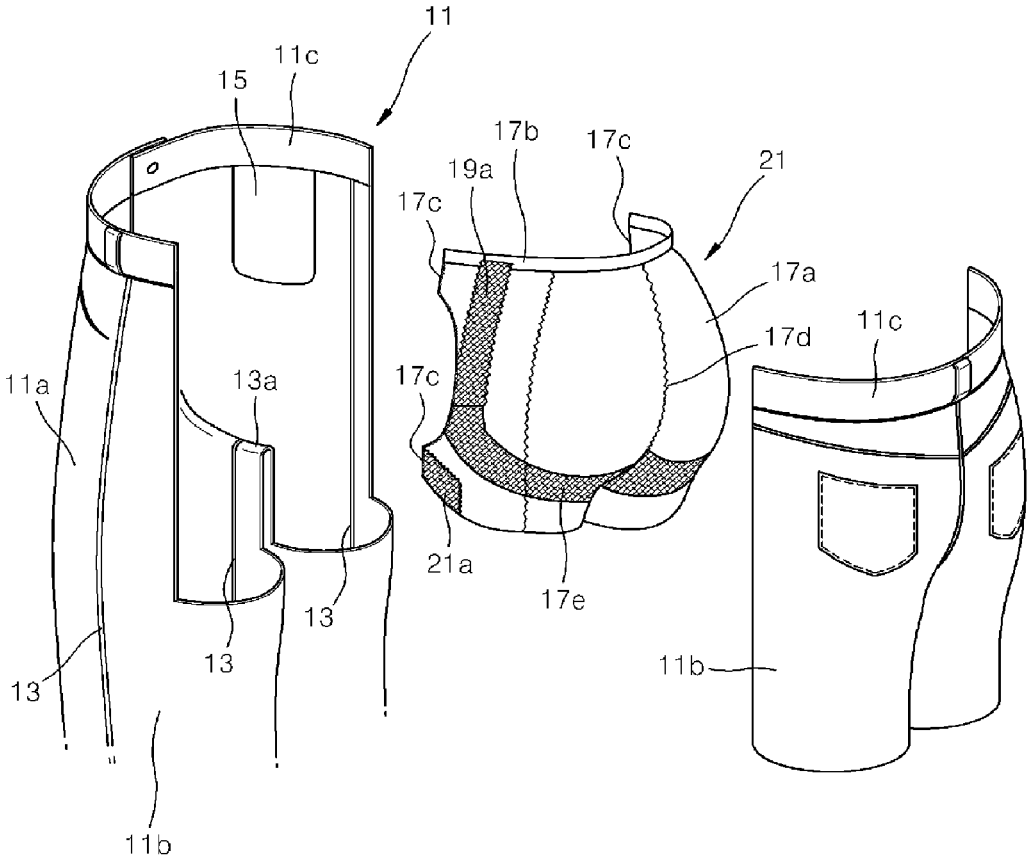
FIG. 5 is an exploded perspective view of an inner structure of pants having a body shaping function according to another embodiment of the present invention.
Figure 6:
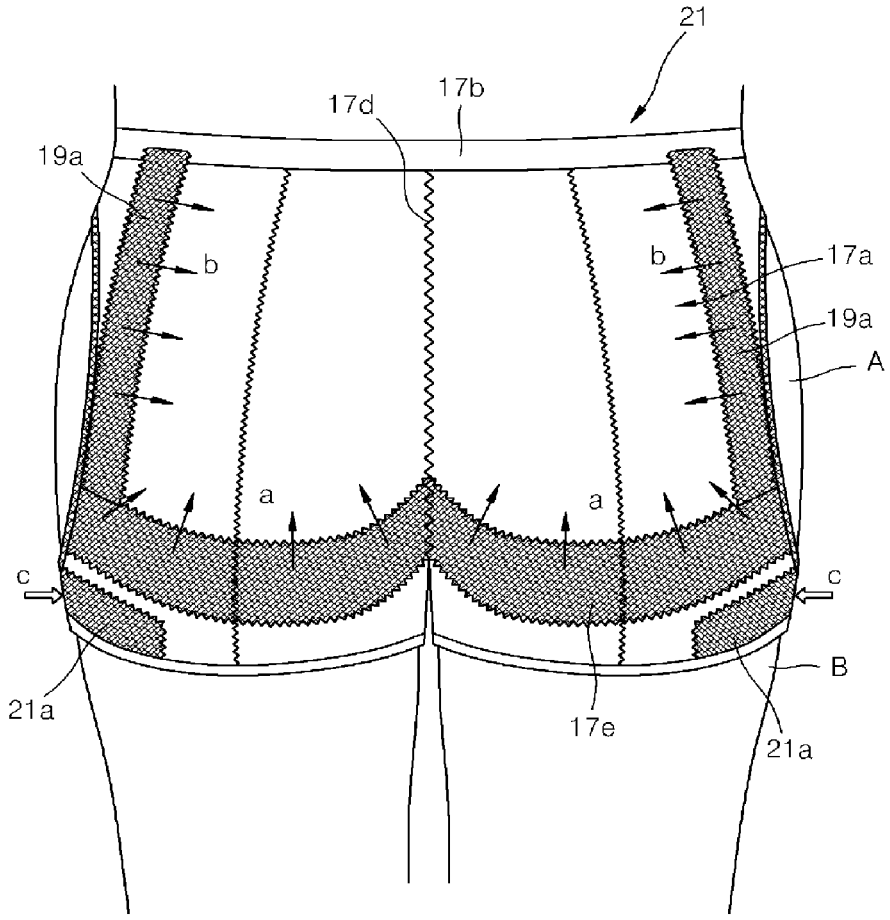
FIG. 6 is a diagram illustrating operations of a girdle of FIG. 5.

FIG. 5 is an exploded perspective view of an inner structure of pants 11 having a body shaping function according to another embodiment of the present invention, and FIG. 6 is a diagram illustrating operations of a girdle of FIG. 5.

Referring to FIGS. 5 and 6, a girdle 21 included in the pants 11 according to the current embodiment further includes compression bands 21*a* unlike the girdle 19 of FIG. 3.

The compression bands 21*a* are fixed on both ends portion of the elastic fabric 17*a* by sewing, and push outer thighs (B) of the wearer in arrow direction c. In a case where outer thighs protrude when the both sides of the hips A are pushed in arrow direction b, the compression bands 21*a* prevent the thighs from protruding. Consequently, the thighs of the wearer look thinner due to the compression bands 21*a*. The compression bands are formed of the same fabric as the hip-up band 17*e*. Moreover, the compression bands 21*a* can be connected to the hip-up band 17*e*, if necessary.

Figure 7:
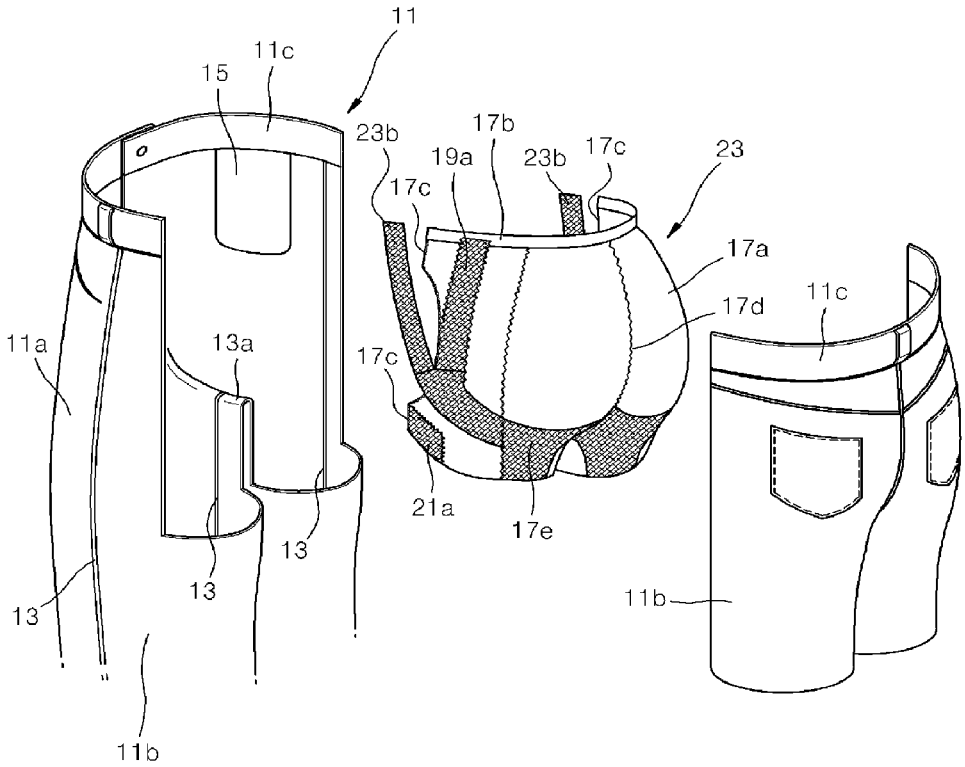
FIG. 7 is an exploded perspective view of an inner structure of pants having a body shaping function according to another embodiment of the present invention.
Figure 8:
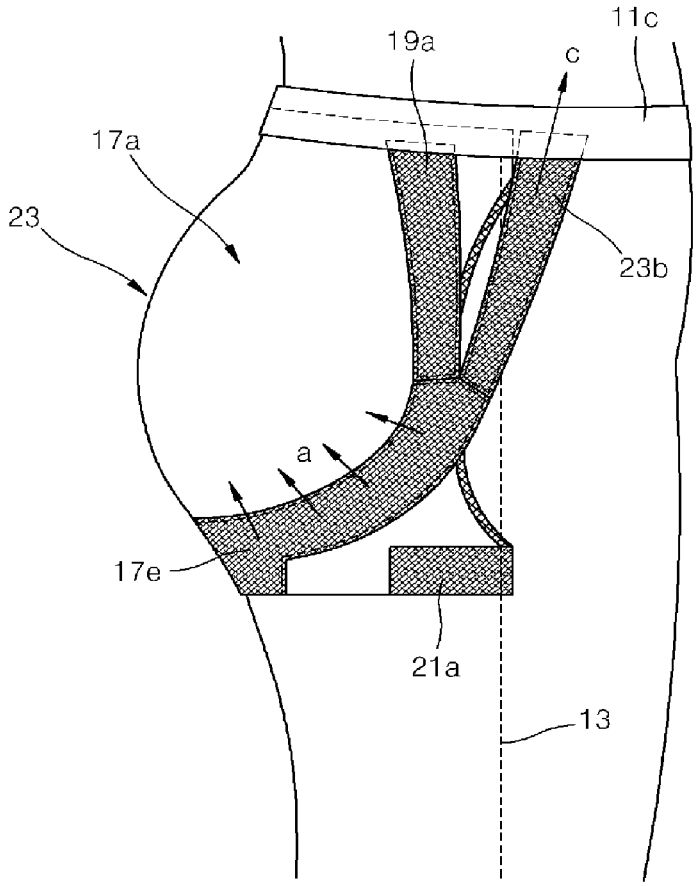
FIG. 8 is a diagram illustrating operations of a girdle of FIG. 7.

FIG. 7 is an exploded perspective view of an inner structure of pants 11 having a body shaping function according to another embodiment of the present invention, and FIG. 8 is a diagram illustrating operations of a girdle of FIG. 7.

Referring to FIGS. 7 and 8, a girdle 23 in the pants 11 according to the current embodiment further includes tensile bands 23*b* in addition to the girdle 21 of FIG. 5. The tensile bands 23*b* have end portions that are fixed onto the both ends of the hip-up band 17*e* and extend in a frontal upper direction, and the extending end portions of the tensile bands 23*b* are inserted into the belt portion 11*c* of the pants 11.

The tensile bands 23*b* are elastic and thus pull the hip-up band 17*e* up in an arrow direction c. In particular, the tensile bands 23*b* do not contact the elastic fabric 17*a*, and the extending end portions of the tensile band 23*b* are fixed on the belt portion 11*c* of the pants 11 so that the elastic fabric 17*a* can be elastically adhered to the hips of the wearer. Therefore, the elastic fabric 17*a* can be adhered to the hips when the wearer moves actively, and thus, the wearer can feel comfortable.

Figure 9:
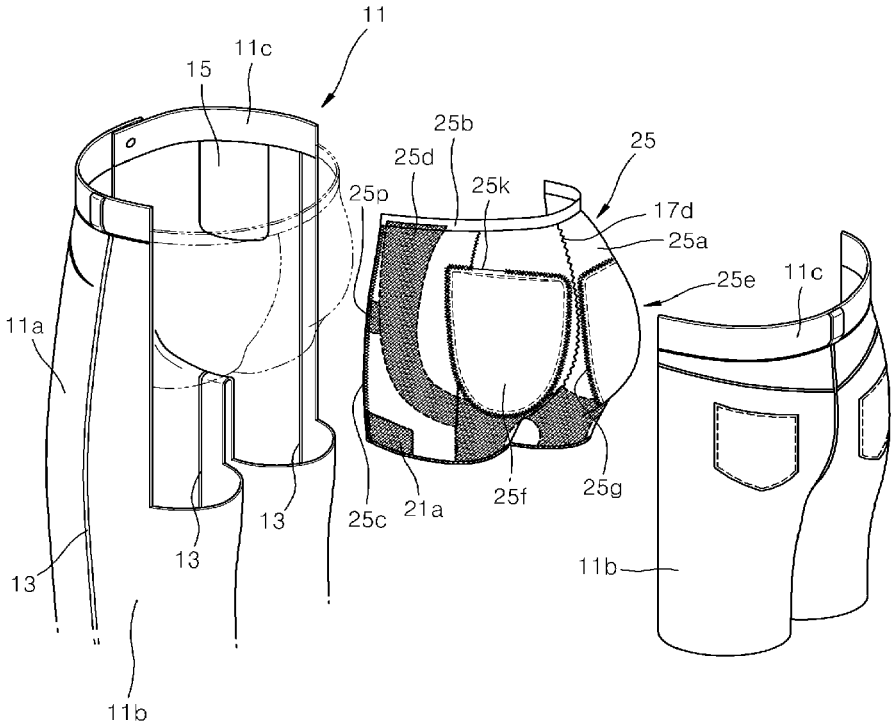
FIG. 9 is an exploded perspective view of an inner structure of pants having a body shaping function according to another embodiment of the present invention.

FIG. 9 is an exploded perspective view of an inner structure of pants 11 having a body shaping function according to another embodiment of the present invention.

Referring to FIG. 9, the pants 11 includes a girdle 25 fixed in the pants 11 to push the hips of the wearer up.

The girdle 25 elastically supports the hips from behind as in the previous embodiments, unlike the conventional girdle. Therefore, if the girdle 25 is separated from the pants 11, the girdle 25 is not wearable anymore.

Side inseam portions 25*c* on both sides of the girdle 25 and a crotch portion are coupled to the sewing portion 13 of the pants 11, and an upper inseam portion 25*b* of the girdle 25 is inserted in the belt portion 11*c* and sewed in the belt portion 11*c*. Therefore, according to the current embodiment, the hips of the wearer are tightened between the front portion 11*a* and the girdle 25. If the pants 11 are tight, the girdle 25 is adhered to the rear portion 11*b* of the pants 11, and thus, the contours of the hips are displayed outward through the girdle 25 and the rear portion 11*b*.

Figure 10:
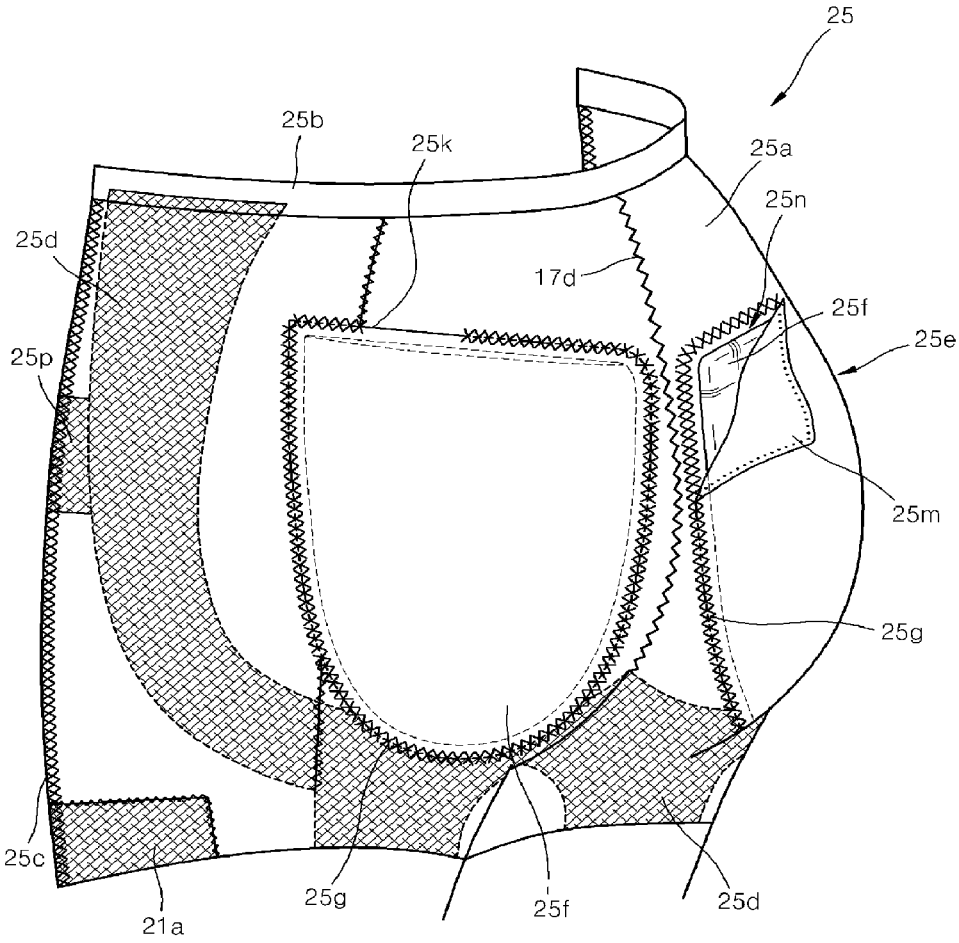
FIG. 10 is a perspective view of a girdle of FIG. 9.

In addition, the girdle 25 includes a hip-shaping band 25*d*, a compression band 21*a*, a second compression band 25*p*, and an elastic pad 25*f* (FIG. 10). The hip-shaping band 25*d* pushes the hips of the wearer up and concentrates the hips so as to make the contours of the hips look more attractive.

The hip-shaping band 25*d* performs the functions of the hip-up band 17*e* and the supporting bands 18*a* simultaneously. In addition, the compression band 21*a* pushes the outer thighs of the wearer to make the thighs look thinner. Moreover, the second compression band 25*p* is formed of the same fabric as that of the hip-shaping band 25*d*, and extends to the side inseam portion 25*c* by being fixed on the hip-shaping band 25*d*. The second compression band 25*p* is coupled to the sewing portion 13 of the pants 11 to push both sides of the hips so that sides of the hips do not protrude and voluminous hip contours can be shown.

The elastic pad 25*f* is an elastic member having a predetermined thickness to make the hips stick out. The elastic pad 25*f* can be used when the wearer has small hips, and may not be used according to the body of the wearer. The elastic pad can be a sponge or a latex pad.

FIG. 10 is a perspective view of girdle 25 of FIG. 9.

Referring to FIG. 10, the girdle 25 included in the pants 11 of the current embodiment includes a flexible elastic fabric 25*a* that is fixed in the pants 11 to be adhered to the hips of the wearer, a hip-shaping band 25*d* formed as a band and sewed on the elastic fabric 25*a*, and compression bands 21*a* disposed on lower portions of the both sides of the elastic fabric 25*a*.

Two pocket portions 25*e* are located on a center portion of the elastic fabric 25*a*, and the elastic pad 25*f* is disposed inside the pocket portions 25*e*. The shape of the girdle 25 can be modified variously.

Figure 11:
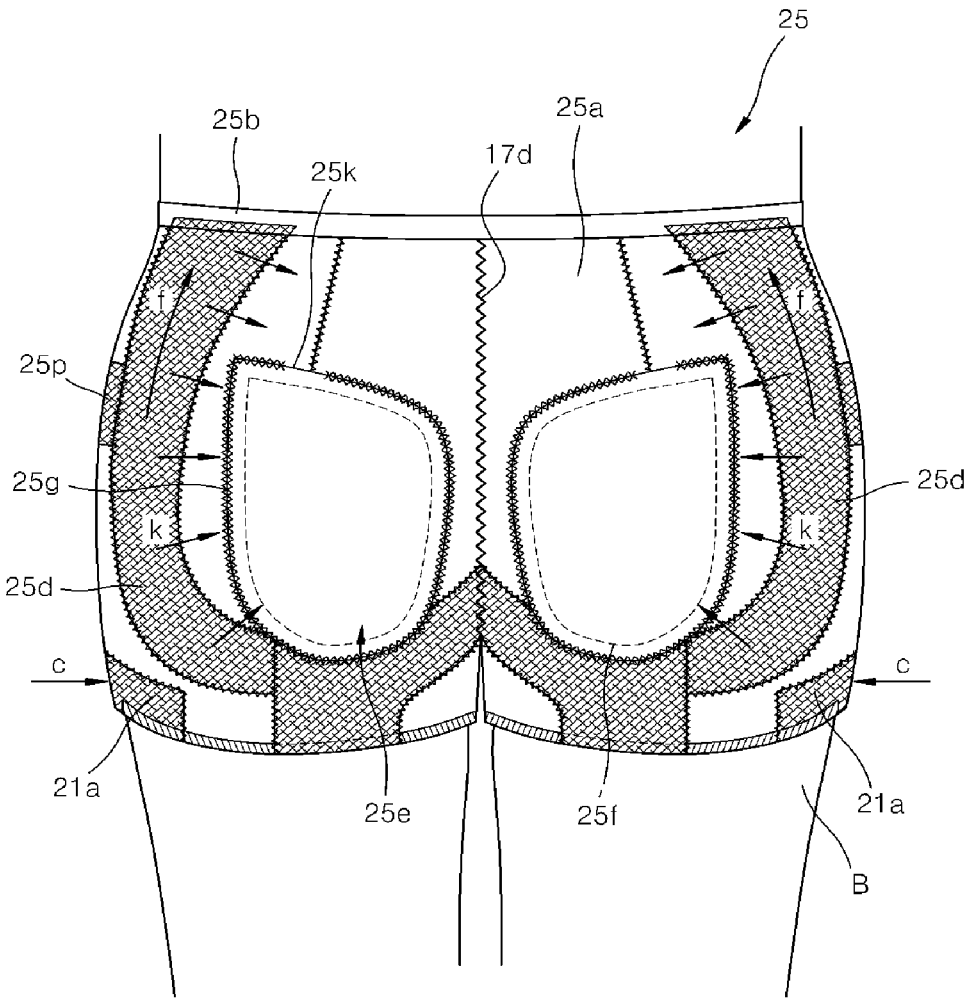
FIGS. 11 and 12 are diagrams illustrating a detailed structure and operations of a girdle of FIG. 10.

The hip-shaping band 25*d* pushes the hips up in an arrow direction k in FIG. 11 to tighten the hips onto the center portion. The hip-shaping band 25*d* is formed of non-elastic fabric. For example, the hip-shaping band 25*d* can be formed of non-elastic tricot fabric, or mesh-type fabric in consideration of air ventilation.

As shown in FIG. 11, the hip-shaping band 25*d* is symmetric with respect to the center portion of the elastic fabric 25*a*, and pull the hips up in an arrow direction f and tightens the hips in the arrow direction k. Therefore, by wearing the pants according to the current embodiment, sagging hips can be pushed up by the hip-shaping band 25*d*, and thus, the contours of the hips can look more attractive and beautiful.

In addition, the pocket portions 25*e* are to locate the elastic pad 25*f* on the corresponding portion of the elastic fabric 25*a*. The pocket portion 25*e* can be formed by sewing a pocket fabric 25*m* for forming a pocket onto the elastic fabric 25*a*. That is, the pocket fabric 25*m* for the pocket is placed on the outer portion of the elastic fabric 25*a*, and a boundary of the fabric 25*m* is sewed to form the pocket having an inner space 25*n*. In particular, a pocket sewing line 25*g* generated by sewing the pocket fabric 25*m* for the pocket onto the elastic fabric 25*a* is not a closed loop, and thus, an opening 25*k* is formed.

The opening 25*k* is a path for opening the inner space 25*n* in the pocket portion 25*e*. The elastic pad 25*f* can be separated from the pocket portion 25*e* through the opening 25*k*, or can be inserted into the inner space 25*n* through the opening 25*k*. The size of the opening 25*k* can be appropriately adjusted according to the size of the pocket portion 25*e*.

Figure 12:
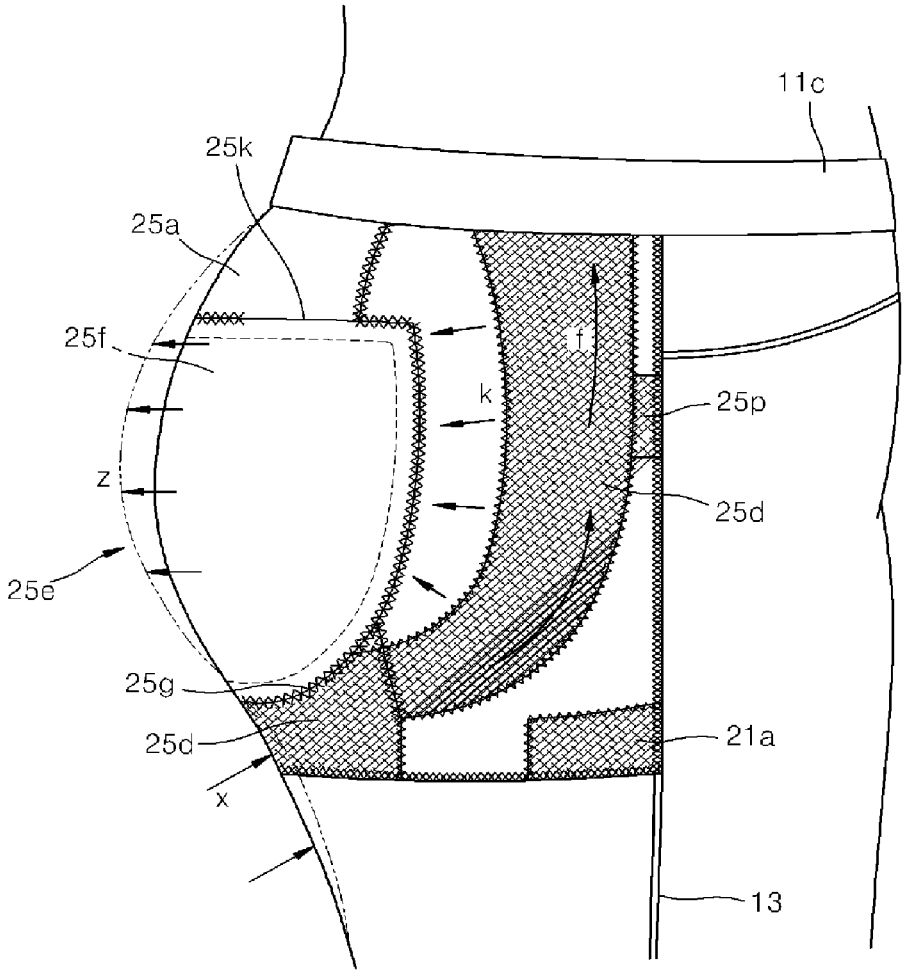

FIGS. 11 and 12 are views illustrating a detailed structure and operations of the girdle 25 of FIG. 10.

Referring to FIG. 11, the hip-shaping band 25*d* is symmetrically sewed on the elastic fabric 25*a*. The hip-shaping band 25*d* pushes the hips of the wearer up in an arrow direction f and includes the pocket portion 25*e* therein, and tightens the hips in the arrow direction k.

As shown in FIG. 12, the lower portion of the hips is tightened in an arrow direction x and the hips protrude in an arrow direction z due to the hip-shaping band 25*d*, and thus, the contours of the hips move upward.

Moreover, the hips protrude further in the arrow direction z by the elastic pad 25*f* included in the pocket portion 25*e*. Thus, the hips can be shaped using the elastic pad 25*f* without excessively tightening the hips by the hip-shaping pad 25*d*. If necessary, the elastic pad 25*f* may not be used when the hips can be shaped sufficiently using the hip-shaping band 25*d*.

The compression bands 21*a* fixed on lower portions of the left and right sides of the elastic fabric 25*a* are formed of the same fabric as that of the hip-shaping band 25*d*. As described above, the compression bands 21*a* push the outer portion of the thighs of the wearer in the arrow direction c to make the thighs look thin.

The shapes of the hip-shaping band and the compressions bands can be modified variously to shape the hips and thighs using the above method.

According to the pants having the body shaping function of the present invention, the girdle in the pants elastically compresses the hips to emphasize the contours of the hips. Therefore, the hips of the wearer look more attractive, and the hips' contour can be well-shaped.

Moreover, the girdle of the present invention can be applied to a skirt if the crotch of the elastic fabric can be fixed thereto.

While the present invention has been particularly shown and described with reference to exemplary embodiments thereof, it will be understood by those of ordinary skill in the art that various changes in form and details may be made therein without departing from the spirit and scope of the present invention as defined by the following claims.

I claim:

1. Pants having a body-shaping function, the pants comprising:

a pants portion comprising a front portion and a rear portion that are coupled to each other and receive the lower part of a body of a wearer, and a belt portion that is fixed to upper ends of the front portion and the rear portion and surrounds a waist of the wearer; and a girdle portion coupled and fixed to the inside of the rear portion of the pants portion, wherein the girdle portion comprises:

an elastic fabric for having elasticity, covering the hips of the wearer, and elastically pressing the hips of the wearer; and a non-elastic fabric hip-up band fixed on the elastic fabric to push the hips up so as to make the contours of the hips voluminous; and non-elastic supporting bands that are fixed on both end portions of the hip-up band and extend upward so as to push the hips inward; and tensile bands that have first ends fixed on both end portions of the hip-up band adjacent the supporting bands and have second ends that extend upward and forward and are fixed on the pants portion so that the elastic fabric is pulled in a direction towards the second ends;

and non-elastic compression bands that are fixed on lower side portions of the elastic fabric in order to compress thighs of the wearer so as to make the thighs look thin.

* * * * *

UNITED STATES PATENT AND TRADEMARK OFFICE

CERTIFICATE OF CORRECTION

PATENT NO. : 8,141,176 B2
APPLICATION NO. : 13/093402
DATED : March 27, 2012
INVENTOR(S) : Sung Woo Lee It is certified that error appears in the above-identified patent and that said Letters Patent is hereby corrected as shown below:

On the Front Page:

Under (*) Notice, please delete "This patent is subject to a terminal disclaimer.".

Signed and Sealed this
Nineteenth Day of June, 2012

David J. Kappos

David J. Kappos
*Director of the United States Patent and Trademark Office*